US008164473B2

(12) United States Patent
Robertson, Jr.

(10) Patent No.: US 8,164,473 B2
(45) Date of Patent: Apr. 24, 2012

(54) MINE ROOF MONITORING APPARATUS

(76) Inventor: Roy Lee Robertson, Jr., Delbarton, WV (US)

( * ) Notice: Subject to any disclaimer, the term of this patent is extended or adjusted under 35 U.S.C. 154(b) by 399 days.

(21) Appl. No.: 12/631,459

(22) Filed: Dec. 4, 2009

(65) Prior Publication Data

US 2010/0141464 A1 Jun. 10, 2010

Related U.S. Application Data

(60) Provisional application No. 61/120,008, filed on Dec. 4, 2008.

(51) Int. Cl.
*G08B 21/00* (2006.01)

(52) U.S. Cl. ..... 340/686.4; 340/686.1; 340/686.3; 340/691.7; 340/693.9

(58) Field of Classification Search ..... 340/686.1, 340/686.3, 686.4, 686.6, 691.7, 693.9, 693.12
See application file for complete search history.

(56) References Cited

U.S. PATENT DOCUMENTS

| | | | | |
|---|---|---|---|---|
| 1,018,328 | A | 2/1912 | Lee et al. | |
| 1,737,514 | A | 11/1929 | Nikolish | |
| 2,692,924 | A | 10/1954 | Williams et al. | |
| 3,594,773 | A | 7/1971 | Conkle et al. | |
| 3,786,503 | A * | 1/1974 | Webb et al. | 405/272 |
| 4,058,079 | A * | 11/1977 | Taylor et al. | 116/283 |
| 4,097,854 | A * | 6/1978 | Black et al. | 340/690 |
| 4,156,236 | A * | 5/1979 | Conkle | 340/690 |
| 4,217,849 | A * | 8/1980 | Brown et al. | 116/212 |
| 4,271,407 | A * | 6/1981 | Kehrman et al. | 340/690 |
| 4,426,642 | A * | 1/1984 | Poffenbarger | 340/690 |
| 4,514,905 | A | 5/1985 | Lutzens | |
| 4,531,403 | A | 7/1985 | de Korompay et al. | |
| 5,539,986 | A * | 7/1996 | De Souza | 33/1 H |
| 6,481,365 | B1 | 11/2002 | Currie et al. | |

* cited by examiner

*Primary Examiner* — Travis Hunnings
(74) *Attorney, Agent, or Firm* — Robert R. Waters; Brian W. Foxworthy; Waters Law Group, PLLC

(57) ABSTRACT

A mine roof monitoring apparatus has at least two contact members. At least one contact member maintains contact with the roof of a mine shaft. At least one contact member maintains contact with a floor of the same mine shaft. A motion monitoring apparatus monitors the relative motion between the two contact members, and a flag on the motion monitoring apparatus changes position, when a predetermined amount of motion occurs between the two contact members. This indicates that the roof of the mine shaft has subsided enough to move the respective contact member.

8 Claims, 8 Drawing Sheets

MINE ROOF MONITORING APPARATUS

This application claims priority from U.S. Provisional Application 61/120,008, filed on Dec. 4, 2008. The entire disclosure contained in U.S. Provisional Application 61/120,008, including the attachments thereto, are incorporated herein by reference.

BACKGROUND OF THE INVENTION

Cave-ins are a very significant safety hazard in mines. Mine shafts sometimes experience cave-ins, collapses, or falling rock due to the layered and stratified makeup of the earth. Frequently, a cave-in is presaged by a measurable sag or subsidence of the roof of the mine shaft. This subsidence may result from the separation of rock layers or other geologic mechanisms and the subsidence of the roof may occur at various depths up into the roof of the mine.

Many prior art devices for monitoring mine roofs are mounted in holes bored into the roof of the mine. These are only capable of monitoring the roof rock up to the depth of the hole, because the measurement being monitored is from the surface of the mine roof to some point on the device mounted in the hole. However, rock layer separation may occur up further in the mine roof than the depth of the hole. This means that a monitoring device that is mounted in a hole will miss the movement, or subsidence, of the mine roof. It is desirable to have a mine roof monitoring apparatus capable of measuring the movement of the mine roof that is not limited to the depth of a mounting hole.

Also, the drilling of the holes in which to mount the monitors is a resource and time consuming process. Mine shafts are confining and not easily accessible. The need to use equipment to drill the holes for mounting the monitors adds a level of work and expense that necessarily reduces the ease and economy of installing the monitors. A more effective and economical means of monitoring mines roofs is needed.

Other prior art devices span between the roof and ceiling to measure ceiling subsidence, but these devices require substantial set-up and some employ electrical measuring techniques. When monitoring a remote location such as a mine shaft or tunnel, ease of set-up is preferred. Similarly, electrical measurements may introduce a degree of complexity not needed for the requirement. Power systems in mines are subject to fluctuations and devices reliant on the power system may generate false positive, while batteries require replacement. Additionally, embodiments of the represent invention need not be monitoring across a strictly vertical distance. Embodiments of the present invention may be employed at angles substantial deviating from vertical, including to a horizontal orientation, however rare monitoring in a horizontal position may be.

RELEVANT ART

U.S. Pat. No. 3,594,773 is for a Mine Roof Gage Indicator. Two telescoping sleeves are disposed between the roof and floor of a mine. Switch trigger means is secured to a first sleeve and a detector actuator is secured to the second sleeve. The trigger and the detector actuator are positioned in registry with one another and separated by a predetermined distance. Displacement of a mine roof by a distance exceeding the predetermined space between the trigger and actuator causes operation of an alarm circuit, thus signaling the occurrence of an emergency situation. A second embodiment utilizes the telescoping sleeves and a displacement gauge mounted thereto for monitoring roof displacement.

U.S. Pat. No. 3,786,503 is for an Earth Movement Indicator. The earth movement indicator is an explosion-proof subsidence-indicator for mines, tunnels and earthworks including a non-conductive body including a battery-actuated warning-light encased in a sealed chamber, and a spring-loaded probe extending outward from the chamber to engage the mine roof.

U.S. Pat. No. 4,058,079 is for a Movement Indicator. In a device for indicating a preset amount of relative movement between two points, an indicator sleeve axially movable in a cylindrical bore in a housing fixed to one of the points remains flush with the housing until the preset amount of movement is reached at which point the sleeve pops up to give a positive, easily identifiable indication of the movement. An actuating rod which bears against and follows the second point is axially slidable in the sleeve and operates a ball bearing mechanism which locks the indicator sleeve in the retracted position. The amount of movement required to generate the discrete indication is easily variable and monitoring of the actual displacement is always available.

SUMMARY OF THE INVENTION

One embodiment of the invention has a contact member in contact with the ceiling of a mine shaft and another contact member in contact with the floor of the mine shaft. A motion monitoring apparatus is attached to one of the contact members. The motion monitoring apparatus has a flag and latch to maintain the flag in a first position, such as a generally horizontal position. The motion monitoring apparatus also has an attaching member to facilitate the attachment of the motion monitoring apparatus to a contact member. The motion monitoring apparatus is attached to one of the contact members with the latch release in proximity to the other contact member. When the monitored mine roof subsides, the contact member in contact with the roof moves with respect to the contact member in contact with the floor. When the mine roof subsides a sufficient amount, the latch is tripped and the flag falls from its initial position.

In one embodiment, the two contact members are interconnected with each other but are driven to expand with respect to each other by a resilient member such as a spring. The contact members and resilient member are sized such that they can be compressed so that the apparatus can be installed in a mine shaft and then allowed to expand so that the apparatus contacts both the mine roof and floor and is maintained in place by the force generated by the resilient member.

In one embodiment, the apparatus comprises a spring loaded rod or post having at least two slidably interconnected tubes. The embodiment has an out tube and an inner tub that slidably fits into the outer tube. A spring having an end anchored in each tube allows the tubes to be compressed with respect to each other and the allowed to expand again. In use, the post is compressed to position it in between the roof and floor of a mine shaft and the spring keeps the rod in place. A flag mechanism is mounted on one of the slidably interconnected tubes. When a mine roof subsides and causes the interconnected tubes to move a predetermined distance with respect to each other, the flag mechanism is tripped. This indicates that the mine roof has subsided at least the distance required to trip the flag, warning anyone observing the monitor that there has been a shift in the roof. By effectively monitoring the distance between the floor and roof of the mine shaft, the present invention in its various embodiments can detect movements of the roof, including in cases that might be missed by a monitor that is mounted in the roof.

Embodiments employing two contact members capable of compression and expansion allow the apparatus to be carried to remote locations and installed by merely compressing the contact members with respect to each other to fit within the mine shaft and then released to obtain fixture within the mine shaft. The motion monitoring apparatus can then be adjusted to detect relative movement of the contact members and therefore the subsidence of the mine roof.

DETAILED DESCRIPTION OF AT LEAST ONE EMBODIMENT

Figure 1:
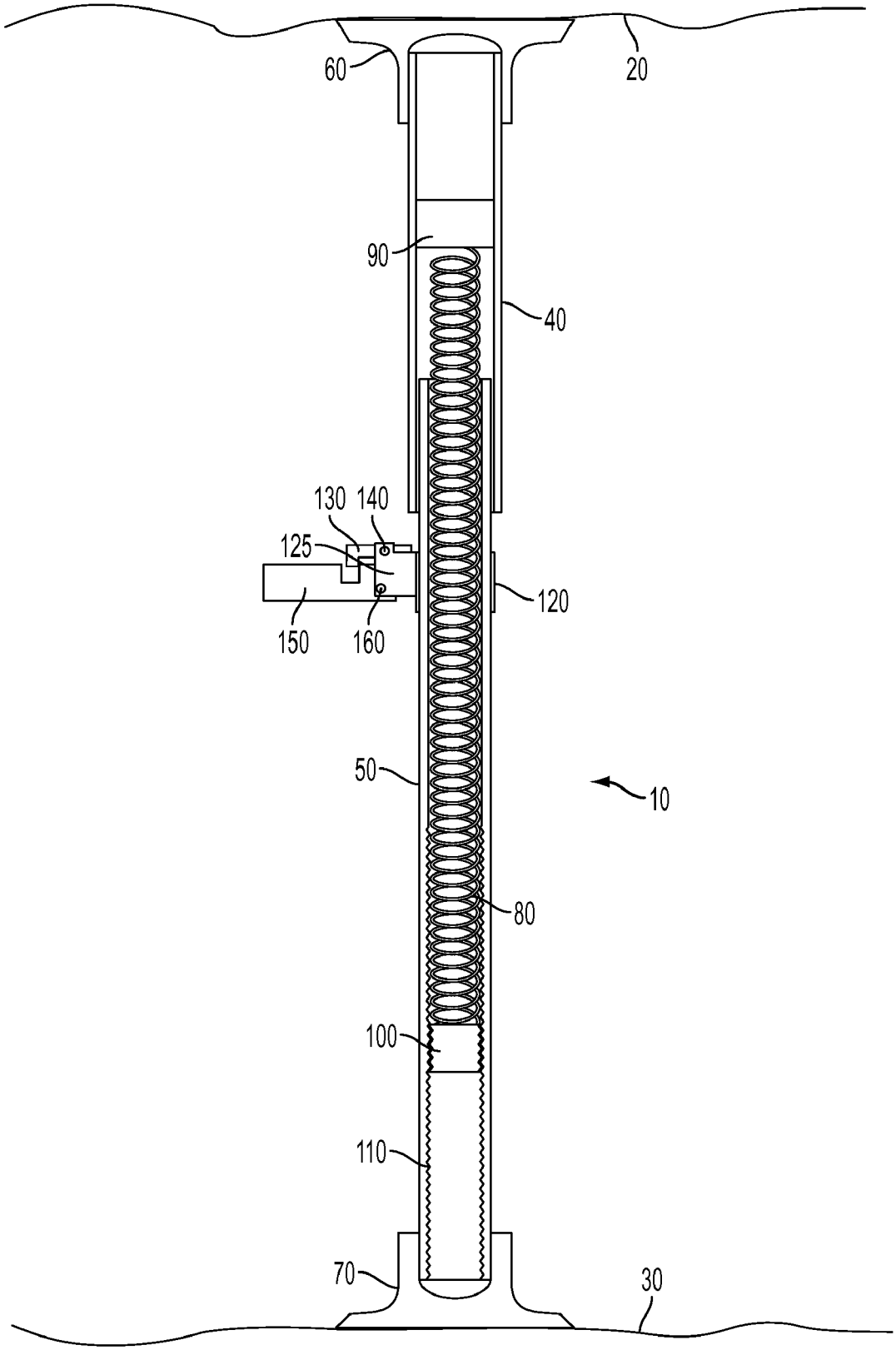
FIG. 1 is a cross sectional view of an embodiment of the mine roof monitoring apparatus of the instant invention.

FIG. 1 shows an embodiment of the mine roof monitoring apparatus 10 installed between a mine roof 20 and mine floor 30 of an underground mine. The mine roof monitoring apparatus 10 has a first contact member comprised of an outer tube 40 and a second contact member comprised of an inner tube 50. Inner tube 50 slidably fits within outer tube 40. On the distal end of outer tube 40 is a head plate 60 which contacts the roof 20 of the mine. On the distal end of inner tube 50 a foot plate 70 is attached which contacts the floor 30 of the mine. A compression spring 80 within the body of the mine roof monitoring apparatus 10 allows outer tube 40 and inner tube 50 to be compressed toward each other for installation and allowed to expand to maintain contact between the mine roof 20 and floor 30. Head plate 60 and foot plate 70 can compensate for uneven surfaces and, in some case, allow an embodiment of the mine roof monitoring apparatus to be installed at an angle from vertical. Alternatively, some embodiments may employ a contact members terminating at points. The points also facilitate orienting these embodiments at substantial angles from vertical.

Spring 80 is attached to stops at each end. Upper stop 90 in outer tube 40 is in a fixed location while lower stop 100 in inner tube 50 is threadably engaged to threads 110 in inner tube 50. To adjust the effective length of the mine roof monitoring apparatus 10, inner tube 50 may be turned with respect to outer tube 40 thus causing lower stop 100 in inner tube 50 to travel along threads 110 within inner tube 50. This changes the position of lower stop 100 in inner tube 50 and changes the effective length of mine roof monitoring apparatus 10 by changing the relative position of spring 80 with respect to inner tube 50 of mine roof monitoring apparatus 10. This ability to adjust the uncompressed span of the two contact members allows the apparatus to be adjusted to fit a wider range of distances between roof and floor.

In the embodiment of FIG. 1, a motion monitoring apparatus is attached to inner tube 50. Collar 120 is mounted on inner tube 50 with flag mount 125 extending from the outer surface of collar 120. Mounted on flag mount 125 are a flag 150 and a latch 130. Latch 130 is released when the roof 20 of the mine subsides and moves outer tube 40 down along inner tube 50 enough that outer tube 40 contacts latch 130 and releases flag 50.

Figure 2:
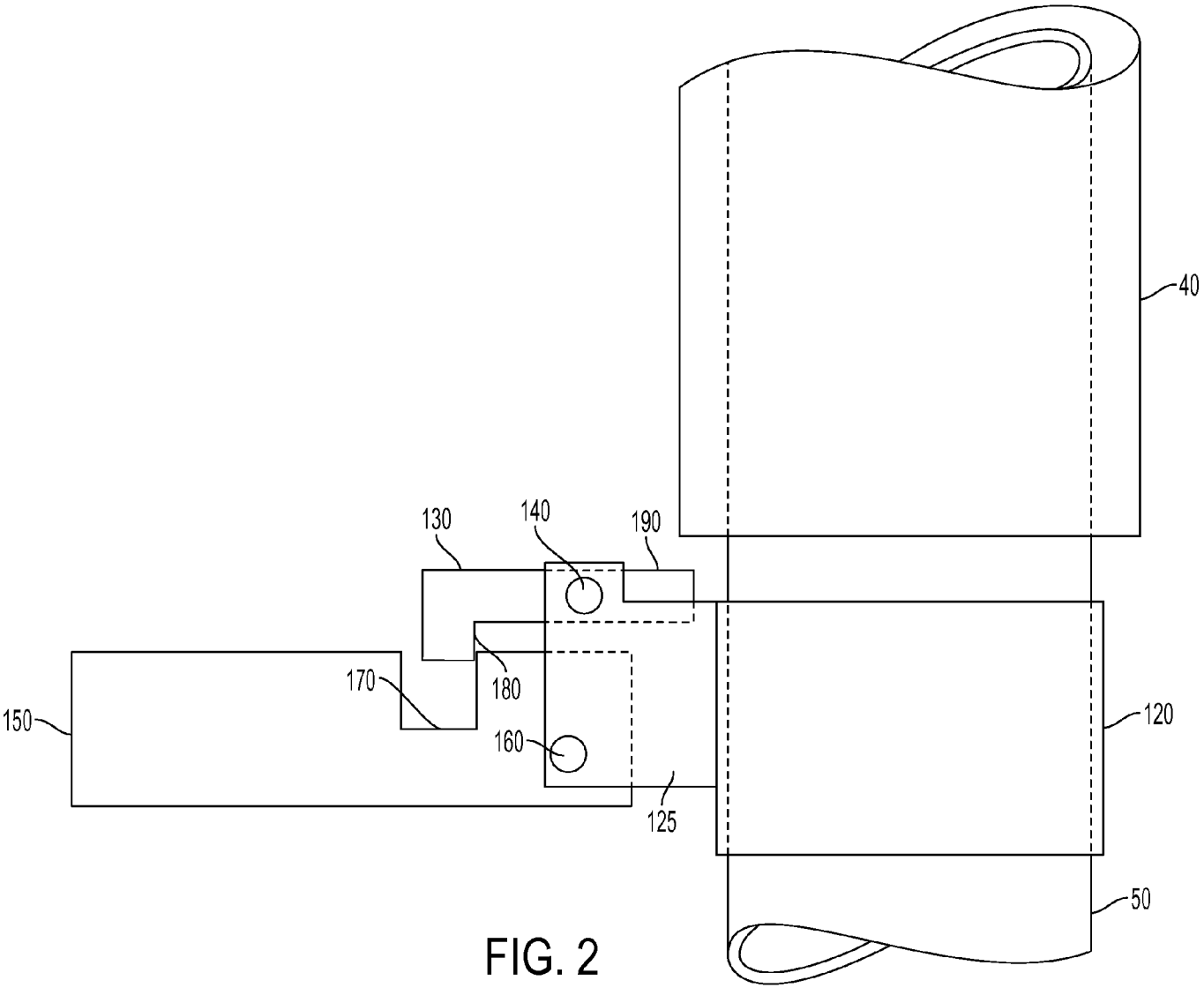
FIG. 2 is a close up view of the motion monitoring apparatus of the embodiment of FIG. 1 with the flag and apparatus in a non-alarm position.

FIG. 2 shows a close-up of collar 120 with flag 150 and latch 130 in a first position on inner tube 50 before outer tube 40 has descended to release flag 150. Latch 130 is mounted on a pivot as well as is flag 150. To position flag 150 for the hold position, it is swung up about flag pivot 160 until latch 130 engages a notch 170 in flag 150. If the mine roof 20 subsides enough to move outer tube 40 into contact with latch release 190 of latch 130, latch 130 will be pivoted about latch pivot 140 and disengaged from notch 170 in flag 150.

Figure 3:
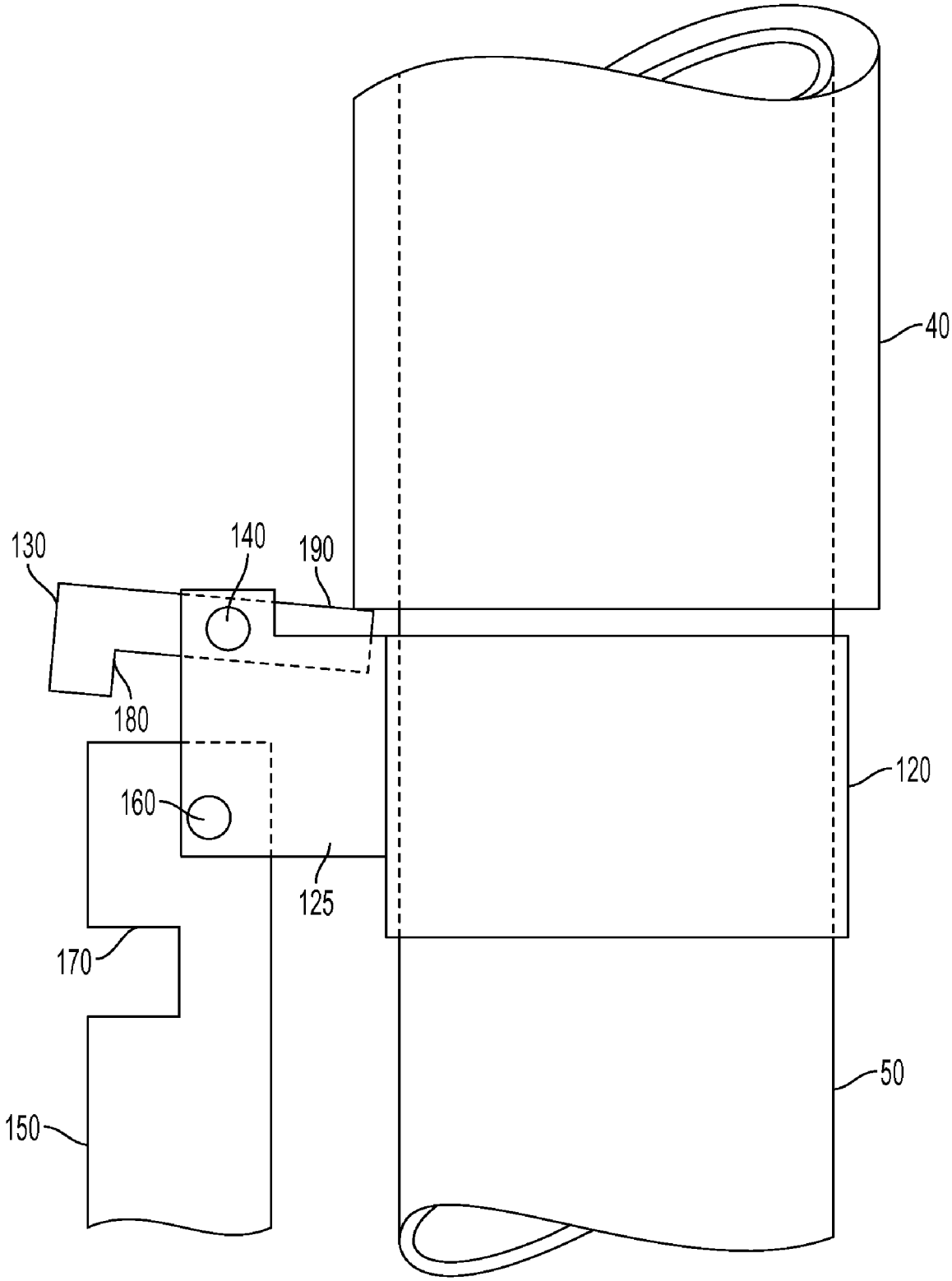
FIG. 3 is a close up view of the motion monitoring apparatus of the embodiment of FIG. 1 with the flag and apparatus in an alarm position.

FIG. 3 shows the position of flag 150 after outer tube 40 has been depressed by the mine roof 20 enough to release latch 130. In FIG. 3, latch 130 has rotated and disengaged from notch 170 in flag 150, and flag 150 has dropped and rotated to a vertical position. The change in position of flag 150 from horizontal to vertical provides an easily identified warning that the mine roof 20 has subsided an amount sufficient to release the flag. The mine roof monitoring apparatus can be set to trip in response to a predetermined amount of movement.

The adjustable effective heights of the mine roof monitoring apparatus 10 and its ease of set up allows it to be installed quickly and without tools. Despite its simplicity, the mine roof monitor apparatus 10 provides visible indications of mine roof subsidence. The adjustability of the mine roof monitor 10 allows it to be used in passages varying widely in height.

Figure 4:
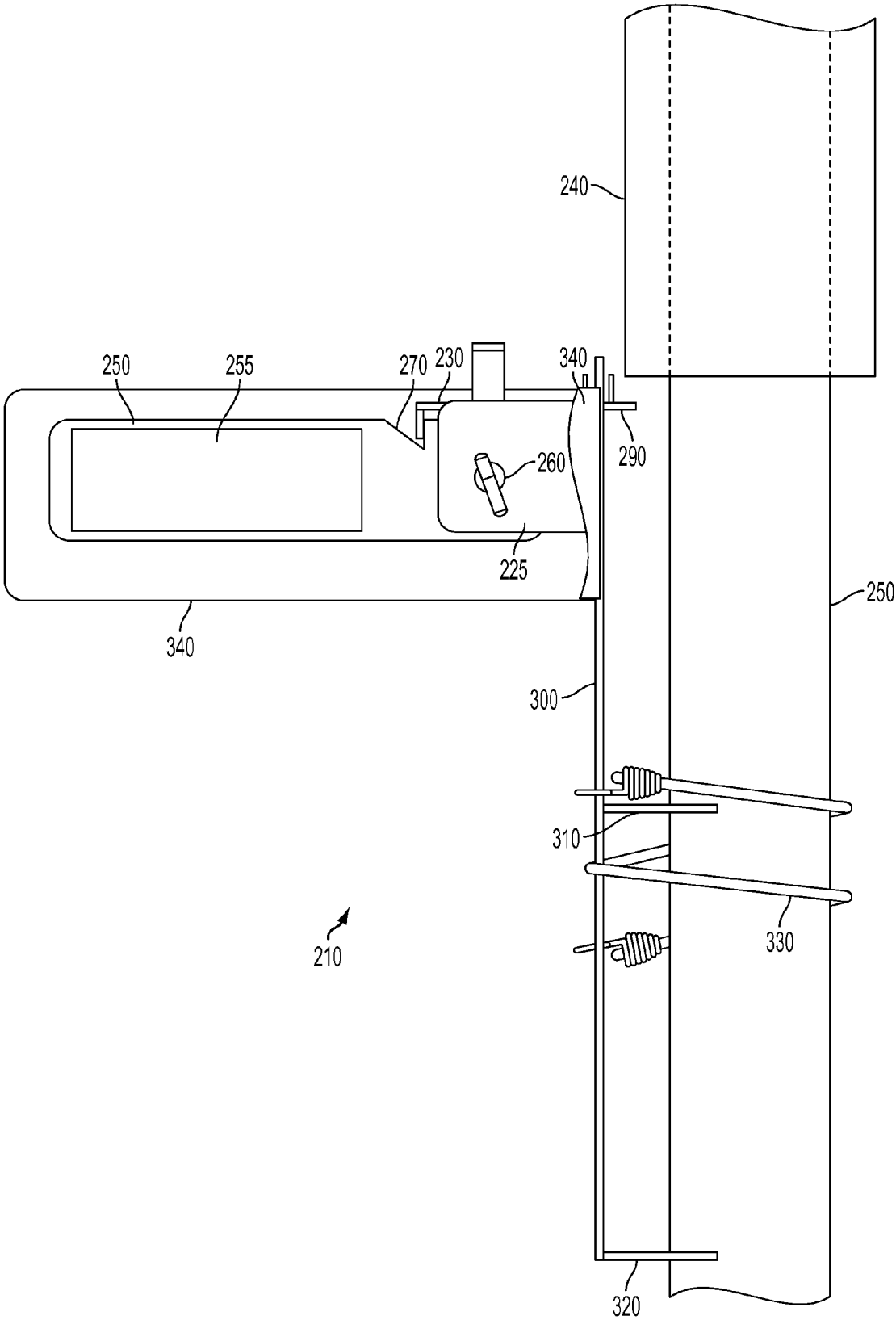
FIG. 4 is a close up side view of the motion monitoring apparatus of a second embodiment with the flag and the rest of the apparatus in a non-alarm position. A shield is cut away for visibility.

Referring now to FIG. 4, a second embodiment of mine roof monitoring apparatus 210 is shown. Two contact members, outer tube 240 and inner tube 250 are slidably engaged with each other, and a motion monitoring apparatus is attached to inner tube 250. Although outer tube 240 and inner tube 250 are truncated in FIG. 4, they extend far enough to make contact with the mine shaft roof and mine shaft floor. In one embodiment, a spring (not shown) internal to outer tube 240 and inner tube 250 biases the tubes out in an expansionary direction.

In the motion monitoring apparatus of the embodiment shown in FIG. 4, flag mount 225 is attached to panel 300. Elastic cord 330 wraps around panel 300 and inner tube 250 to affix the motion monitoring apparatus to inner tube 250. Elastic cord 330 may be unhooked to allow separation of the motion monitoring apparatus from the contact members, outer tube 240 and inner tube 250. This allows ease of transport and set-up of this embodiment of the mine roof monitoring apparatus.

Flag 250 is attached to flag mount 225 at flag pivot 260. Flag 250 has a notch 270 along its top edge which latch 230 engages to maintain flag 250 in a first, generally horizontal position. This first position is the "set" position flag 250, i.e. the position at which flag 250 is placed when this embodiment of the mine roof monitoring apparatus is set-up to monitor a location.

Latch release 290 extends back from flag mount 225 and latch 230 and into proximity to the first contact member, in this embodiment, outer tube 240. Latch release 290 extends into the path of motion of outer tube 240. When the contact members have enough relative movement between them, latch release 290 is moved and releases latch 290. In many embodiments, even once latch release 290 is contacted, latch release 290 will require some additional movement to unlatch flag 250. The distance of movement required to actually unlatch flag 250 once latch release 290 is the minimum distance of mine roof subsidence that can be measured by change of position of flag 250. For that minimum measurement, the mine roof monitoring apparatus is setup with one of the contact members already in contact with the latch release. To measure greater movements, an offset is established between the latch release 290 and the relevant contact member. The distance measured by the unlatching of the flag is then the distance latch release 290 requires plus the offset established at setup.

Figure 5:
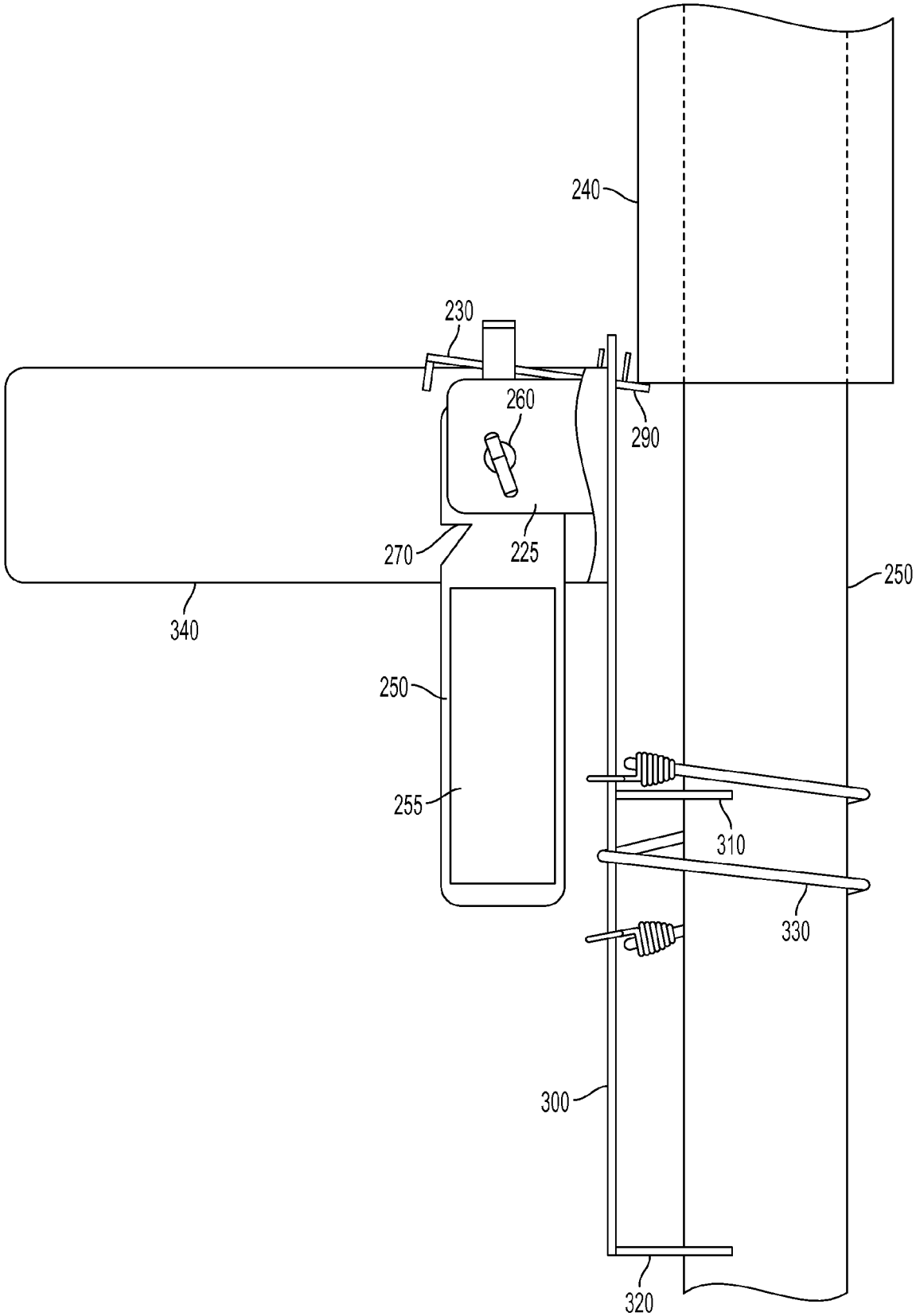
FIG. 5 is a close up side view of the motion monitoring apparatus of the embodiment of FIG. 4 with the flag and the rest of the apparatus in a non-alarm position. A shield is cut away for visibility.

In the embodiment shown in FIGS. 4-7, flag 250 also has section of surface area having enhanced reflectivity. This reflective surface 255 provides higher visibility and ease of monitoring in the transient and artificial light environments of mines. The embodiment shown in FIGS. 4-7 also has shields 340 on both sides of flag 250. In FIGS. 4 and 5, one shield 340 is trimmed away to show other elements.

In FIG. 5, one contact member, outer tube 240 has moved enough to cause latch release 290 to unlatch flag 250, allowing flag 250 to move to a second position. In this embodiment, gravity is sufficient to move flag 250 from its first, set, position, to a second, release, position. In the second position, most of flag 250, especially reflective surface 255, has moved out from between shields 340 to be visible. This provides an easy visual cue that flag 250 has changed positions, indicating that the mine roof has moved, or subsided, the predetermined amount.

In the embodiment shown in FIGS. 4-7, panel 300 has yokes 310 and 320 extending from its back side. Yokes 310 and 320 are contoured to conform to the expected contact member, which, in the embodiment shown, is inner tube 250. The contour of yokes 310 may vary depending on the expected contours of the contact member to which the motion monitoring apparatus will be attached.

Figure 6:
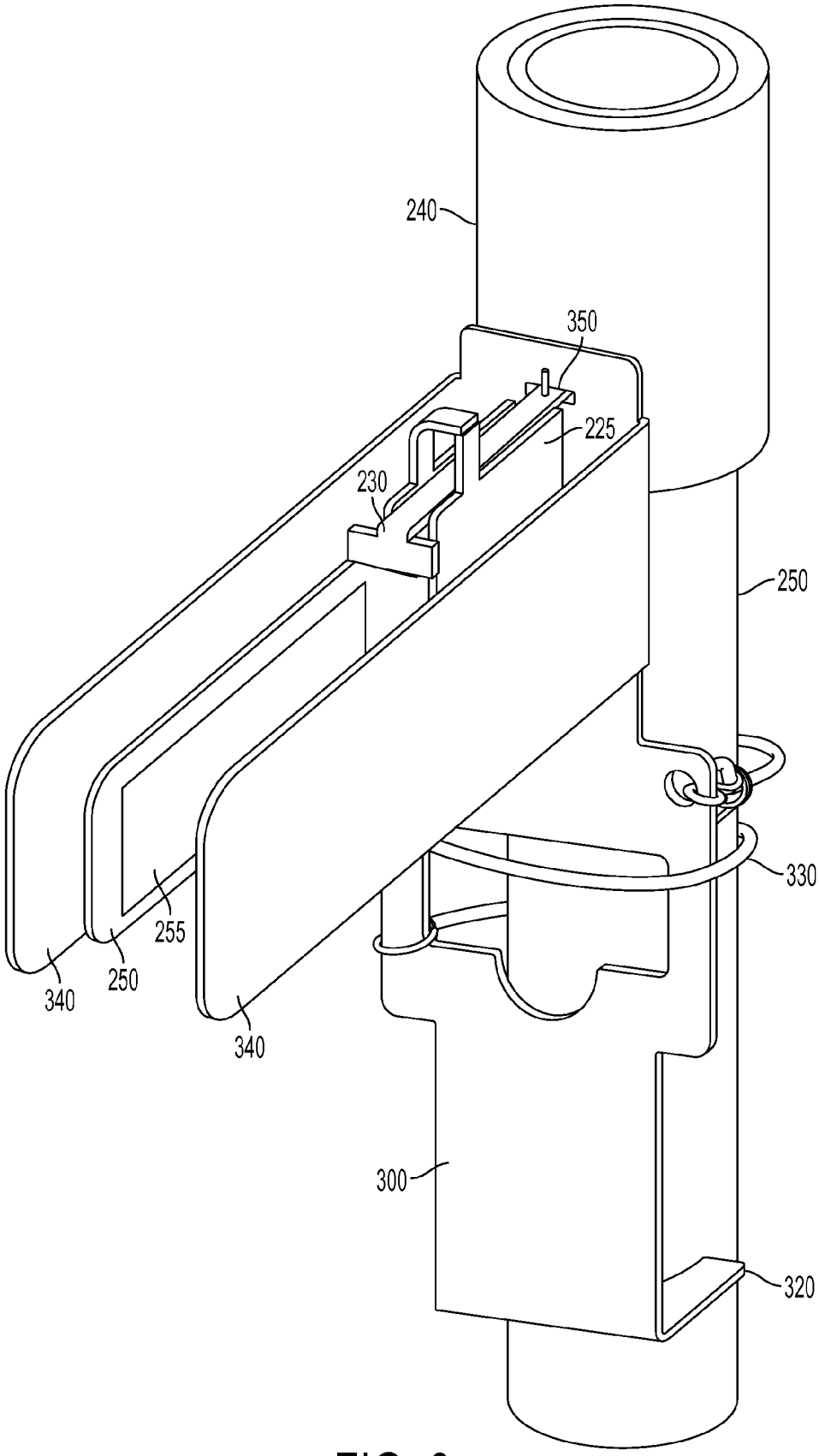
FIG. 6 is a perspective view of the embodiment of FIG. 4 in non-alarm position.

FIG. 6 is a perspective view of the embodiment of the mine roof monitoring apparatus of FIG. 4. Outer tube 240 and inner tube 250 are truncated. Both shields 340 are shown in position in FIG. 6. Shields 340 are positioned on both sides of flag 250 when flag 250 is in its first position. Shields 340 restrict the view of flag 250 in its first position, providing a more clear indication when flag 250 moves to its second, released, position. In the embodiment of FIG. 6, when flag 250 moves from its first position to its second position, flag 250 moves out from in between shields 340. Reflective surface 255 on flag 250 enhances the visibility of an exposed flag 250, providing a more clear indication that flag 250 has moved to its second position.

Figure 7:
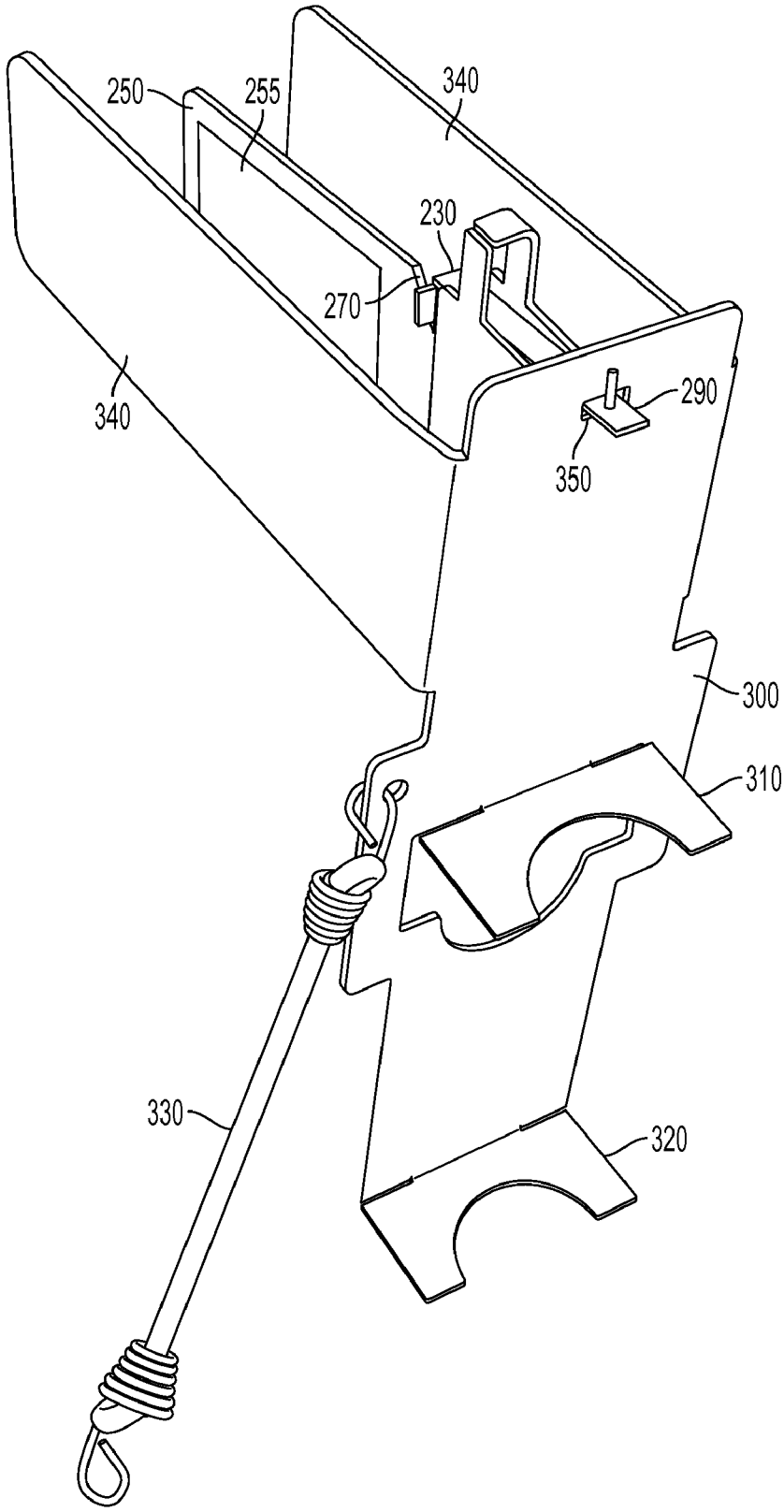
FIG. 7 is perspective view of the back of the motion monitoring apparatus part of the embodiment shown in FIG. 4.

In FIG. 6, fulcrum aperture 350 allows communication between latch release 290 and latch 230. In FIG. 7, latch release 290 may be seen extending from fulcrum aperture, 350 in panel 300. Also visible in FIG. 7 are the particular contours of yokes 310 and 320 for the embodiments shown.

Figure 8:
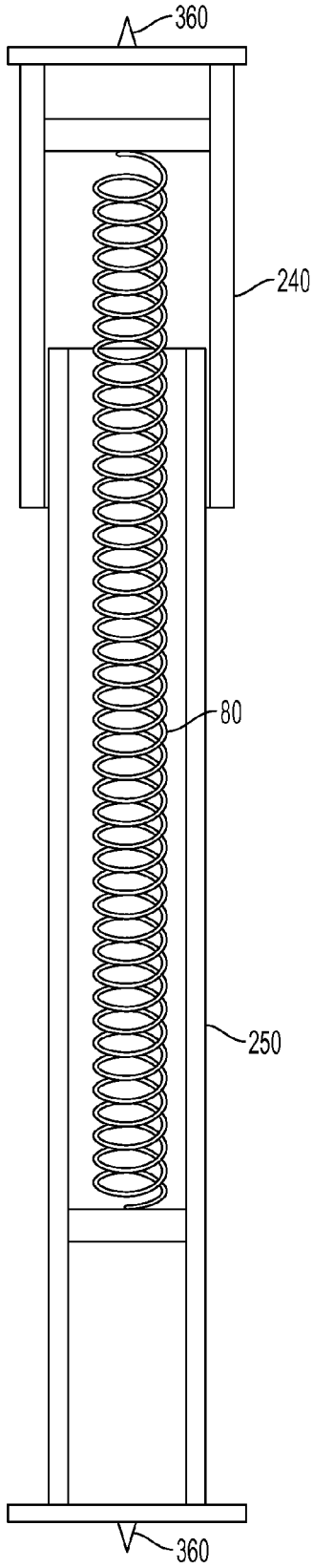
FIG. 8 is a cross sectional view of two contact members and a spring allowing their compression and expansion.

FIG. 8 shows two contact members of an embodiment along with a resilient member urging the two contact members out in an expansive manner. In the portion of an embodiment shown in FIG. 8, the first contact member is an outer tube 240, the second contact member is an inner tube 250, and the resilient member is a spring 80 contained within the tubes with one end anchored in each tub. While a resilient member such as spring 80 facilitates each of setup and maintenance of position for the mine roof monitoring apparatus, some embodiments may employ friction between the two contact members to maintain contact with the mine roof and floor. A subsiding mine would be able to overcome substantial amounts of frictional resistance. Also shown in FIG. 8 are spikes 360 to provide traction at respective surfaces resulting in stability for the mine roof monitoring apparatus.

While particular embodiments have been shown and discussed, they should not be seen as limiting the possible applications and features of the present invention. For example, a method of adjusting the length of the mine roof monitoring apparatus is discussed. The method discussed threads inside the inner tube. Other methods could be used to adjust the effective length of the mine roof monitoring apparatus such as incremental apertures in the inner tube and pins engaging the apertures to relocate the lower stop. Similarly, the mechanism of the latch, latch release, and flag could vary. Various resilient members or friction generating methods may be employed to maintain installation of the mine roof monitoring apparatus.

I claim:

1. A mine roof monitoring apparatus, comprising;

a first contact member and a second contact member operatively associated with each other and resiliently biased in an expansive manner;

and a motion monitoring apparatus attachable to either said first contact member or said second contact member, said motion monitoring apparatus comprising;

an attaching member;

a flag mount having an extending end and a base end, said base end of said flag mount being fixed to said attaching member;

a flag having at least a first end edge and a top edge with a latch receiver on said top edge proximal to said first end edge, said flag being pivotally connected proximal to its first end edge to said flag mount;

a latch operationally associated with said flag mount and attaching member, said latch capable of engaging said latch receiver to maintain said flag in a first position, and;

a latch release;

wherein, said first contact member is maintained in contact with a mine roof and said second contact member is maintained in contact with a mine floor by being resiliently biased away from each other, and;

said attaching member attaches said motion monitoring apparatus to either said first contact member or said second contact member with said latch release in proximity to the complimentary contact member, and wherein, when said mine roof subsides a predetermined amount, said first contact member moves said predetermined amount with respect to said second contact member, causing said latch release to unlatch said flag from said first position.

2. The mine roof monitoring apparatus of claim 1, wherein:

said first contact member is an outer tube and said second contact member is an inner tube slidably inserted into said outer tube.

3. The mine roof monitoring apparatus of claim 1, wherein:

said attaching member is a collar and said flag mount is attached to the outer surface of said collar, said collar encircling said contact member to attach said motion monitoring apparatus.

4. The mine roof monitoring apparatus of claim 1, wherein;

said attaching member is a panel having a front side and a back side and said flag mount is attached to said front side, and wherein;

said mine roof monitoring apparatus further comprises an elastic cord which wraps around both said panel and said contact member to attach said motion monitoring apparatus to said contact member, said back side of said panel contacting said contact member.

5. The mine roof monitoring apparatus of claim 4, wherein;

said attaching member further comprises at least one yoke extending from the back side of said panel, said at least one yoke contoured to fit said contact member.

6. The mine roof monitoring apparatus of claim 4, wherein;

said panel has a fulcrum aperture through it to allow said latch release to pass through.

7. The mine roof apparatus of claim 1, further comprising;

at least one reflective surface on the sides of said flag.

8. The mine roof apparatus of claim 1, further comprising;

at least one shield panel extending from said attaching member, said at least one shield panel shielding said flag when said flag is in said first position.

* * * * *